US012043814B2

(12) United States Patent
Zhang et al.

(10) Patent No.: US 12,043,814 B2
(45) Date of Patent: Jul. 23, 2024

(54) USE OF A TRIAZOLE COMPOUND AS AN ADDITIVE FOR IMPROVING THE ANTI-CORROSION PROPERTIES OF A LUBRICANT COMPOSITION FOR A PROPULSION SYSTEM OF AN ELECTRIC OR HYBRID VEHICLE

(71) Applicant: TotalEnergies OneTech, Courbevoie (FR)

(72) Inventors: Shimin Zhang, Solaize (FR); Hakim El-Bahi, Solaize (FR); Julien Guérin, Solaize (FR)

(73) Assignee: TOTALENERGIES ONETECH, Courbevoi (FR)

( * ) Notice: Subject to any disclaimer, the term of this patent is extended or adjusted under 35 U.S.C. 154(b) by 0 days.

(21) Appl. No.: 17/619,857

(22) PCT Filed: Jun. 25, 2020

(86) PCT No.: PCT/EP2020/067819
§ 371 (c)(1),
(2) Date: Dec. 16, 2021

(87) PCT Pub. No.: WO2020/260457
PCT Pub. Date: Dec. 30, 2020

(65) Prior Publication Data

US 2022/0364011 A1 Nov. 17, 2022

(30) Foreign Application Priority Data

Jun. 28, 2019 (FR) ..... 1907140

(51) Int. Cl.

| | |
|---|---|
| ***C10M 141/08*** | (2006.01) |
| ***C10M 129/70*** | (2006.01) |
| ***C10M 133/46*** | (2006.01) |
| ***C10M 133/56*** | (2006.01) |
| ***C10M 135/36*** | (2006.01) |
| ***C10M 169/04*** | (2006.01) |
| *C10N 30/06* | (2006.01) |
| *C10N 30/12* | (2006.01) |
| *C10N 40/02* | (2006.01) |
| *C10N 40/04* | (2006.01) |

(52) U.S. Cl.
CPC ..... *C10M 141/08* (2013.01); *C10M 129/70* (2013.01); *C10M 133/46* (2013.01); *C10M 133/56* (2013.01); *C10M 135/36* (2013.01); *C10M 169/04* (2013.01); *C10M 2203/003* (2013.01); *C10M 2207/281* (2013.01); *C10M 2215/28* (2013.01); *C10M 2215/30* (2013.01); *C10M 2219/106* (2013.01); *C10N 2030/06* (2013.01); *C10N 2030/12* (2013.01); *C10N 2040/02* (2013.01); *C10N 2040/04* (2013.01)

(58) Field of Classification Search
CPC ..... C10M 133/46; C10M 133/56; C10M 135/36; C10M 169/04; C10M 2203/003; C10M 2207/281; C10M 2215/28; C10M 2215/30; C10M 2219/106; C10M 2219/022; C10M 141/06; C10M 2215/223; C10M 2223/043; C10M 2223/047; C10M 133/44; C10N 2030/06; C10N 2030/12; C10N 2040/02; C10N 2040/04; C10N 2040/14; C10N 2040/255
USPC ..... 508/273
See application file for complete search history.

(56) References Cited

U.S. PATENT DOCUMENTS

| | | | |
|---|---|---|---|
| 2,366,074 | A | 12/1944 | Wasson et al. |
| 4,661,273 | A | 4/1987 | Frangatos et al. |
| 6,001,780 | A | 12/1999 | Ho et al. |
| 8,400,030 | B1 | 3/2013 | Tang et al. |
| 10,099,857 | B2 | 10/2018 | Meyer |
| 2003/0224948 | A1 | 12/2003 | Dam et al. |
| 2004/0209786 | A1 | 10/2004 | Sagawa et al. |
| 2004/0259743 | A1 | 12/2004 | Butke |
| 2006/0035791 | A1 | 2/2006 | Donnelly et al. |
| 2006/0128574 | A1 | 6/2006 | Dong et al. |
| 2007/0087945 | A1 | 4/2007 | Quest et al. |
| 2008/0194442 | A1 | 8/2008 | Watts et al. |
| 2008/0234153 | A1 | 9/2008 | Matsui |
| 2008/0287329 | A1 | 11/2008 | Lancon et al. |
| 2009/0275491 | A1 | 11/2009 | Komatsubara et al. |

(Continued)

FOREIGN PATENT DOCUMENTS

| | | | |
|---|---|---|---|
| CN | 108085095 | A | 5/2018 |
| EP | 1159380 | A1 | 12/2001 |

(Continued)

OTHER PUBLICATIONS

Non-Final Office Action for copending U.S. Appl. No. 17/619,872, dated Feb. 16, 2023.
International Search Report and Written Opinion for counterpart Application No. PCT/EP2020/067819, dated Sep. 3, 2020.
International Search Report and Written Opinion for counterpart Application No. PCT/EP2020/067820, dated Oct. 2, 2020.
International Search Report and Written Opinion for counterpart Application No. PCT/EP2020/067822, dated Sep. 9, 2020.

(Continued)

*Primary Examiner* — Prem C Singh
*Assistant Examiner* — Francis C Campanell
(74) *Attorney, Agent, or Firm* — The Marbury Law Group, PLLC

(57) ABSTRACT

The invention relates to the use of at least one triazole compound as an additive for improving the anti-corrosion properties of a lubricant composition for a propulsion system of an electric or hybrid vehicle, said lubricant composition comprising one or more amino and/or sulfur anti-wear additives. The invention also relates to the use of a lubricant composition for lubricating a propulsion system of an electric or hybrid vehicle.

12 Claims, 1 Drawing Sheet

(56) References Cited

U.S. PATENT DOCUMENTS

| | | | | |
|---|---|---|---|---|
| 2010/0130390 | A1* | 5/2010 | Tipton | C10M 141/10 508/273 |
| 2013/0012421 | A1* | 1/2013 | Smith | C10M 171/02 508/578 |
| 2013/0143783 | A1 | 6/2013 | Deckman et al. | |
| 2016/0230115 | A1 | 8/2016 | Mosier et al. | |
| 2019/0119597 | A1 | 4/2019 | Sunagawa | |
| 2019/0249102 | A1 | 8/2019 | Martin et al. | |
| 2019/0316056 | A1 | 10/2019 | Hanthom et al. | |
| 2020/0216774 | A1 | 7/2020 | Abraham et al. | |
| 2021/0253928 | A1 | 8/2021 | Lacroix et al. | |
| 2021/0269694 | A1 | 9/2021 | Lacroix et al. | |
| 2021/0277322 | A1 | 9/2021 | Lacroix et al. | |
| 2022/0131205 | A1 | 4/2022 | Champagne | |
| 2022/0372392 | A1 | 11/2022 | Zhang et al. | |

FOREIGN PATENT DOCUMENTS

| | | | |
|---|---|---|---|
| EP | 1405897 | A1 | 4/2004 |
| EP | 2692841 | A1 | 2/2014 |
| JP | 2002-003877 | A | 1/2002 |
| RO | 111107 | B1 | 6/1996 |
| WO | 00/46325 | A1 | 8/2000 |
| WO | 2006/064138 | A1 | 6/2006 |
| WO | 2014/096329 | A1 | 6/2014 |
| WO | 2017/031145 | A1 | 2/2017 |
| WO | 2017/083243 | A1 | 5/2017 |
| WO | 2019/036285 | A1 | 2/2019 |
| WO | 2020/260458 | A1 | 12/2020 |
| WO | 2020/260460 | A1 | 12/2020 |
| WO | 2020/260462 | A1 | 12/2020 |

OTHER PUBLICATIONS

International Search Report and Written Opinion for counterpart Application No. PCT/EP2020/067825, dated Oct. 13, 2020.

Non-Final Office Action for copending U.S. Appl. No. 17/619,859, dated Apr. 18, 2023.

Non-Final Office Action for copending U.S. Appl. No. 17/619,863, dated Apr. 19, 2023.

Non-Final Office Action in U.S. Appl. No. 17/619,859, mailed Dec. 13, 2023, 12 pages.

Final Office Action for copending U.S. Appl. No. 17/619,863, dated Oct. 12, 2023.

Final Office Action for copending U.S. Appl. No. 17/619,872, dated Oct. 25, 2023.

Final Office Action for copending U.S. Appl. No. 17/619,859, dated Apr. 9, 2024.

* cited by examiner

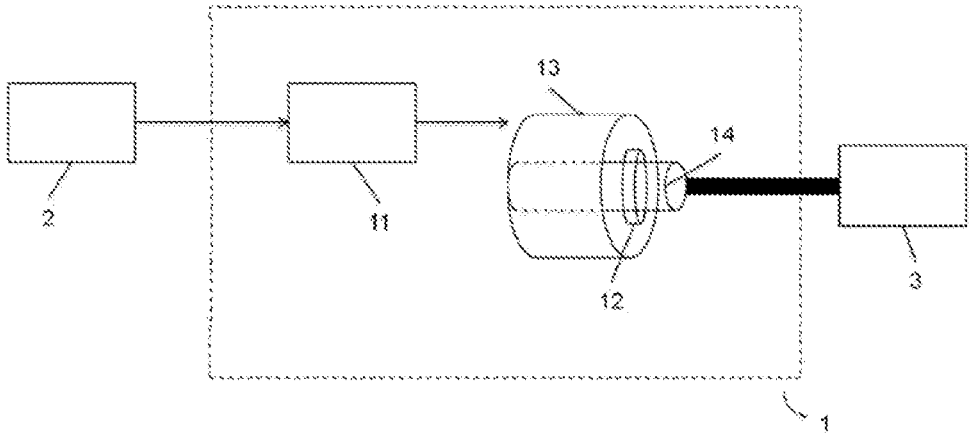
13
14
2
11
12
3
1

USE OF A TRIAZOLE COMPOUND AS AN ADDITIVE FOR IMPROVING THE ANTI-CORROSION PROPERTIES OF A LUBRICANT COMPOSITION FOR A PROPULSION SYSTEM OF AN ELECTRIC OR HYBRID VEHICLE

CROSS REFERENCE TO RELATED APPLICATION

This is a national stage application of PCT/EP2020/067819, filed internationally on Jun. 25, 2020, which claims priority to French Application No. 1907140, filed on Jun. 28, 2019, both of which are incorporated by reference herein in their entireties.

The present invention relates to the field of lubricant compositions for a propulsion system of an electric or hybrid vehicle. The invention more particularly relates to the use of triazole compounds as additives for improving the anticorrosion properties of a lubricant composition incorporating one or more amine-based and/or sulfur-based antiwear additives.

TECHNICAL FIELD

The changes in the international standards for the reduction of $CO_2$ emissions, but also for the reduction of energy consumption, has driven motor vehicle constructors toward proposing alternative solutions to combustion engines.

One of the solutions identified by motor vehicle constructors consists in replacing combustion engines with electric motors. The research aimed at reducing $CO_2$ emissions has thus led to the development of electric vehicles by a certain number of motor vehicle companies.

For the purposes of the present invention, the term "electric vehicle" denotes a vehicle comprising an electric motor as sole means of propulsion, as opposed to a hybrid vehicle which comprises a combustion engine and an electric motor as combined means of propulsion.

For the purposes of the present invention, the term "propulsion system" denotes a system comprising the mechanical parts required for propelling an electric vehicle. The propulsion system thus more particularly encompasses an electric motor, comprising the rotor-stator assembly of the power electronics (dedicated to regulating the speed), a transmission and a battery.

In general, it is necessary to use, in electric or hybrid vehicles, lubricant compositions, also known as "lubricants", for the main purposes of reducing the friction forces between the various parts of the propulsion system of the vehicle, notably between the metal parts in motion in the motors. These lubricant compositions are also effective for preventing premature wear or even damage of these parts, and in particular of their surface.

To do this, a lubricant composition is conventionally composed of one or more base oils which are generally combined with several additives intended for stimulating the lubricant performance of the base oil, for instance friction-modifying additives, but also for affording additional performance.

In particular, "antiwear" additives are considered in order to reduce the wear of the parts of the propulsion system, notably the mechanical parts of the motor, and thus to prevent degradation of the durability of the motor.

A wide variety of antiwear additives exists, among which mention may be made, for example, of dimercaptothiadiazoles, polysulfides, notably sulfur-based olefins, amine phosphates, or else phospho-sulfur additives, for instance metal alkylthiophosphates, in particular zinc alkylthiophosphates and more specifically zinc dialkyldithiophosphates or ZnDTP.

Among these antiwear additives, the ones that are notably favored are amine-based and/or sulfur-based antiwear agents, such as dimercaptothiadiazoles, zinc dithiophosphate or polysulfides.

Unfortunately, these amine-based and/or sulfur-based antiwear additives, such as dimercaptothiadiazoles, have the drawback of being corrosive. The problem of corrosion is particularly critical in electric propulsion systems. In particular, corrosion can lead to a risk of deterioration of the stator and rotor windings, the sensors in the propulsion system, the solenoid valves in the hydraulic system, but also of the rolling bearings between the rotor and stator of an electric motor, which are generally copper-based and thus particularly susceptible to corrosion, or to the seals or varnishes in the propulsion system.

In addition, in order to be able to cool the propulsion systems of electric or hybrid vehicles, it is essential that the lubricant be insulating in order to avoid any failure in the electrical components. In particular, a conductive lubricant can lead to a risk of electrical current leakage in the stator and rotor windings, which thus reduces the efficiency of the propulsion systems, and creates possible overheating of the electrical components, even to the point of damaging the system. In the context of using lubricants for electric or hybrid vehicle powertrain systems, it is thus crucial for the lubricants to have good "electrical" properties in addition to non-corrosive properties.

The present invention is directed, specifically, towards overcoming this drawback.

SUMMARY OF THE INVENTION

More precisely, the present invention relates to the use of at least one triazole compound, as an additive for improving the anticorrosion properties of a lubricant composition intended for a propulsion system of an electric or hybrid vehicle and comprising one or more amine-based and/or sulfur-based antiwear additives.

Triazole compounds, for instance triazoles, notably 1,2,3-triazole and derivatives thereof or else benzotriazole and derivatives thereof, are already known for their corrosion-inhibiting properties, as described, for example, in document EP 1 159 380.

To the inventors' knowledge, it has, however, never been proposed to use triazole compounds, together with one or more amine-based and/or sulfur-based antiwear additives, in the context of using a lubricant for a propulsion system of an electric or hybrid vehicle, to simultaneously improve the antiwear properties and the anticorrosion properties.

Surprisingly, as illustrated in the example that follows, the inventors have found that the addition according to the invention of a triazole compound in a lubricant composition dedicated to a propulsion system of an electric or hybrid vehicle, together with an amine-based and/or sulfur-based antiwear additive, such as a dimercaptothiadiazole additive, makes it possible to efficiently inhibit corrosion, unlike in particular other additives, which are nevertheless known as anticorrosion additives, such as organic acid esters, N-acyl sarcosines, for example N-oleoyl-sarcosine or imidazoline derivatives.

Thus, the specific combination of at least one triazole compound and at least one amine-based and/or sulfur-based antiwear additive makes it possible to reduce, or even to avoid, the corrosion notably caused by the presence within the lubricant composition of said amine-based and/or sulfur-based antiwear additive(s).

For the purposes of the present invention, the term "anticorrosion additive" denotes an additive for preventing or reducing the corrosion of metal parts. An anticorrosion additive thus makes it possible to confer good "anticorrosion properties" on a composition which contains it.

The use of one or more triazole compounds according to the invention together with one or more amine-based and/or sulfur-based antiwear additives advantageously affords access to a lubricant composition which simultaneously has good antiwear performance, while at the same time overcoming the corrosion problems mentioned previously. A composition according to the invention thus simultaneously has good antiwear and anticorrosion properties.

The corrosive (or corroding) power of a compound may be evaluated by means of a test involving study of the variation in the electrical resistance value of a copper wire of a preestablished diameter, as a function of the duration of immersion of this wire in a composition comprising said test compound in a noncorrosive medium, for example in one or more base oils. The variation in this electrical resistance value is directly correlated with the variation in the diameter of the test wire. Thus, in the context of the present invention, a compound is termed "noncorrosive" when the loss of diameter of the copper wire studied is less than or equal to 0.5 μm after immersion for 80 hours, in particular less than or equal to 0.2 μm after immersion for 20 hours in the composition comprising said compound.

The dielectric properties of a lubricant are notably represented by the electrical resistivity and the dielectric loss (tan δ) and may be measured according to the standard IEC 60247.

The electrical resistivity represents the capacity of a material to oppose the circulation of an electric current. It is expressed in ohm-metres (Ω·m). The resistivity must not be low to prevent electrical conduction.

The electric dissipation factor or the loss angle tangent. The loss angle δ is the complementary angle of the phase shift between the applied voltage and the alternating current. This factor reflects the Joule-effect energy losses. Heating is thus directly linked to the δ value. A transmission oil typically has a tan δ value of the order of unity at ambient temperature. A good insulating lubricant must maintain a low tan δ level.

Advantageously, the triazole compound used according to the invention is chosen from optionally substituted triazoles, in particular 1,2,3-triazole; benzotriazoles and derivatives thereof, in particular tolyltriazole (also called tolutriazole) and derivatives thereof, and tetrahydrobenzotriazoles and derivatives thereof; and mixtures thereof.

Preferably, the triazole compound is a benzotriazole or one of the derivatives thereof, preferably a benzotriazole derivative, more preferentially a tolyltriazole derivative.

The introduction, into a lubricant composition intended for a propulsion system of an electric or hybrid vehicle, of one or more triazole compounds according to the invention thus advantageously permits the use, in the composition, of amine-based and/or sulfur-based antiwear additives, such as dimercaptothiadiazoles, without, however, entailing an adverse corrosive effect.

The amine-based and/or sulfur-based antiwear additives used in a lubricant composition according to the invention are more particularly detailed in the text hereinbelow. They are preferably chosen from amine-based and sulfur-based antiwear additives. They may preferably be thia(di)azole compounds, in particular dimercaptothiadiazole derivatives.

In addition, a composition that is suitable for use in the invention has the advantage of being easy to formulate. Besides good antiwear and anticorrosion performance, it has good stability, notably with respect to oxidation, and also good properties in terms of electrical insulation.

The present invention also relates to the use, for lubricating a propulsion system of an electric or hybrid vehicle, in particular for lubricating the electric motor and the power electronics of an electric or hybrid vehicle, of a lubricant composition comprising:

- one or more anticorrosion additives of triazole type as defined in the invention; and
- one or more amine-based and/or sulfur-based antiwear additives as defined in the invention.

A subject of the present invention is also a process for lubricating a propulsion system of an electric or hybrid vehicle, comprising at least one step of placing at least one mechanical part of said system in contact with a lubricant composition comprising at least one additive of triazole type as defined in the invention and at least one amine-based and/or sulfur-based antiwear additive as defined in the invention.

Advantageously, a lubricant composition according to the invention is used for lubricating the electric motor itself, in particular the rolling bearings located between the rotor and the stator of an electric motor, and/or the transmission, in particular the reducer, in an electric or hybrid vehicle.

Other features, variants and advantages of the use of triazole compounds according to the invention will emerge more clearly on reading the description and the examples that follow, which are given as nonlimiting illustrations of the invention.

In the continuation of the text, the expressions "between . . . and . . . ", "ranging from . . . to . . . " and "varying from . . . to . . . " are equivalent and are intended to mean that the limits are included, unless otherwise mentioned.

BRIEF DESCRIPTION OF THE DRAWINGS

FIG. 1 schematically represents a propulsion system of an electric or hybrid vehicle.

DETAILED DESCRIPTION

Additives of Triazole Type

As stated previously, the additive used as anticorrosion agent according to the invention, together with one or more amine-based and/or sulfur-based antiwear additives, in a lubricant composition for the powertrain system of an electric or hybrid vehicle, is a triazole compound.

Triazole compounds are already known for their anticorrosion properties.

However, as indicated previously, such compounds have never been proposed, together with the use of one or more amine-based and/or sulfur-based antiwear additives, in a lubricant composition intended for a propulsion system of an electric or hybrid vehicle.

Triazole compounds are monocyclic or polycyclic compounds comprising at least one 5-membered ring incorporating three nitrogen atoms.

Triazole compounds are more particularly chosen from triazoles and derivatives thereof.

Triazoles of general formula $C_2H_3N_3$ may exist in the forms below, respectively 1H-1,2,3-triazole, 2H-1,2,3-triazole, 1H-1,2,4-triazole and 4H-1,2,4-triazole:

[Chem 1]

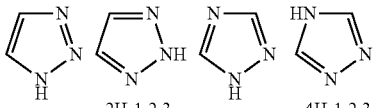

1H-1,2,3-triazole 2H-1,2,3-triazole 1H-1,2,4-triazole 4H-1,2,3-triazole

Benzotriazole compounds are specific triazole derivatives comprising a triazole ring coupled with a benzene ring, as shown below:

[Chem 2]

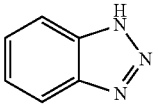

The triazole compound used according to the invention is preferably chosen from optionally substituted triazoles, in particular 1,2,3-triazole; benzotriazoles and derivatives thereof, in particular tolyltriazole and derivatives thereof and tetrahydrobenzotriazoles and derivatives thereof; and mixtures thereof.

The triazole compound may thus be chosen from optionally substituted triazoles, in particular 1,2,3-triazole; benzotriazoles and derivatives thereof; and mixtures thereof, preferably it is a benzotriazole derivative, more preferentially a tolyltriazole derivative.

Substituted triazoles which may be mentioned in particular are 1,2,3-triazoles substituted by one or more groups chosen from alkyl, arylamino and acyl groups.

According to a particular embodiment, the additive of triazole type used according to the invention may be chosen from 1,2,3-triazole and derivatives thereof, corresponding to formula (I) below:

[Chem 3]

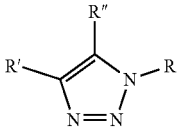

in which R, R' and R" are chosen, independently of each other, from a hydrogen, an alkyl group, preferably a $C_1$ to $C_{24}$ alkyl group, an amine group such as a group —$NR^1R^2$, an acyl group such as a group —$COR^3$, or an aryl group such as a phenyl or tolyl group; with $R^1$, $R^2$ and $R^3$ being chosen, independently of each other, from a hydrogen atom or a $C_1$ to $C_{24}$, preferably $C_2$ to $C_{18}$, alkyl group.

Benzotriazole derivatives which may be mentioned in particular are benzotriazoles substituted by one or more groups chosen, for example, from alkyl groups, for instance tolutriazole (also called tolyltriazole), ethylbenzotriazole, hexylbenzotriazole, octylbenzotriazole, etc., alkyl groups substituted by one or more amine functions, aryl groups, for instance a phenolbenzotriazole, alkylaryl or arylalkyl groups, or other substituents such as hydroxy, alkoxy, halogen etc. groups.

According to a particularly preferred embodiment, the additive of triazole type used according to the invention may be chosen from benzotriazole and derivatives thereof, in particular corresponding to formula (II) below:

[Chem 4]

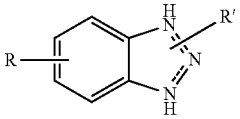

in which R and R' are chosen, independently of each other, from a hydrogen atom, a $C_1$ to $C_{24}$ alkyl group, optionally substituted by one or more groups —$NR^4R^5$; a group —$NR^1R^2$, an acyl group of type —$COR^3$ and an aryl group such as a phenyl or tolyl group:

with $R^1$, $R^2$ and $R^3$ being chosen, independently of each other, from a hydrogen atom or a $C_1$ to $C_{24}$, preferably $C_2$ to $C_{18}$, alkyl group;

and $R^4$ and $R^5$ representing, independently of each other, a hydrogen atom, a linear or branched, preferably branched, $C_3$ to $C_{14}$, preferably $C_6$ to $C_{12}$, alkyl group.

Preferably, the triazole compound is tolyltriazole or one of the derivatives thereof.

Preferably, the triazole compound is a tolyltriazole derivative of formula (IIa) below:

[Chem 5]

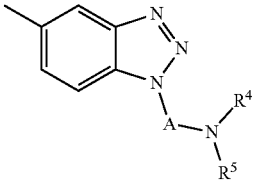

in which $R^4$ and $R^5$ are, independently of each other, as defined above for formula (II); and -A- represents a linear or branched, preferably linear, $C_1$ to $C_6$, preferably $C_1$ to $C_3$, alkylene group and more preferentially a methylene group (—$CH_2$—), in particular, said tolyltriazole derivative being 2-ethyl-N-(2-ethylhexyl)-N-[(4-methylbenzotriazol-1-yl)methyl]hexan-1-amine.

According to a particular embodiment, the triazole compound is of formula (IIa), in which $R^4$ and $R^5$ represent branched $C_6$ to $C_{12}$ alkyl groups and -A- represents a $C_1$ to $C_3$ alkylene group, preferably a methylene group.

In the context of the present invention, and unless indicated otherwise, the following definitions apply:

A halogen represents an atom chosen from fluorine, le chlorine, le bromine or iodine.

An alkyl group represents a linear or branched hydrocarbon-based chain. For example, a Cx-Cz alkyl group represents a linear or branched hydrocarbon-based chain comprising from x to z carbon atoms.

An alkylene group represents a linear or branched divalent alkyl group. For example, a $C_x$-$C_z$ alkylene group represents a linear or branched divalent hydrocarbon-based chain of x to z carbon atoms.

An alkoxy group represents a radical —O-alkyl, in which the alkyl group is as defined previously.

An aryl group represents a monocyclic or polycyclic aromatic group in particular comprising between 6 and 10 carbon atoms. Examples of aryl groups that may be mentioned include phenyl and naphthyl groups.

Preferably, the triazole compound is a benzotriazole or one of the derivatives thereof, preferably a benzotriazole derivative, more preferentially a tolyltriazole derivative.

The triazole compounds required according to the invention may be commercially available or prepared according to synthetic methods known to those skilled in the art.

The invention is not limited to the triazole compounds specifically described above. Other triazole compounds, notably triazole or benzotriazole derivatives, notably tolyltriazole derivatives, may be used as anticorrosion additives according to the invention.

It is understood that, in the context of the present invention, a triazole compound may be in the form of a mixture of at least two triazole compounds, in particular as defined previously.

The triazole compound(s), in particular as defined previously, may be used in a lubricant composition according to the invention in a proportion of from 0.01% to 5% by mass, in particular from 0.1% to 3% by mass, and more particularly from 0.5% to 2% by mass, relative to the total mass of the lubricant composition.

Lubricant Composition

Amine-Based and/or Sulfur-Based Antiwear Additives

As indicated previously, a lubricant composition under consideration according to the invention comprises one or more amine-based and/or sulfur-based antiwear additives.

The term "amine-based and/or sulfur-based antiwear additive" denotes an additive chosen from amine-based antiwear additives, sulfur-based antiwear additives and amine-based and sulfur-based antiwear additives.

The term "antiwear additive" denotes a compound which, when used in a lubricant composition, notably a lubricant composition for a propulsion system of an electric or hybrid vehicle, makes it possible to improve the antiwear properties of the composition.

The amine-based and/or sulfur-based antiwear additive may be chosen, for example, from additives of thia(di)azole type, in particular dimercaptothiadiazole derivatives; polysulfide additives, notably sulfur-based olefins; amine phosphates; phospho-sulfur additives such as alkylthiophosphates; and mixtures thereof.

Thia(di)azole Additives

According to a particularly preferred embodiment, a lubricant composition under consideration according to the invention comprises at least one thia(di)azole antiwear additive.

Thia(di)azole compounds are compounds which contain both a sulfur atom and at least one nitrogen atom in a five-atom ring. Benzothiazoles are a particular type of thia(di)azoles. This term "thia(di)azole" includes, besides cyclic compounds containing one sulfur atom and one nitrogen atom per five-atom ring, also thiadiazoles which contain sulfur and two nitrogen atoms in such a ring.

In particular, the thia(di)azole compounds may be chosen from benzothiazole derivatives, thiazole derivatives and thiadiazole derivatives.

Preferably, the antiwear additive may be a thiadiazole derivative.

Thiadiazoles are heterocyclic compounds comprising two nitrogen atoms, one sulfur atom, two carbon atoms and two double bonds, of general formula $C_2N_2SH_2$, which may exist in the following forms, respectively: 1,2,3-thiadiazole; 1,2,4-thiadiazole; 1,2,5-thiadiazole; 1,3,4-thiadiazole:

[Chem 6]

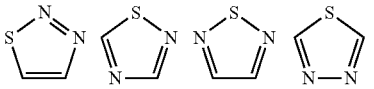

1,2,3-thiadiazole 1,2,4-thiadiazole 1,2,5-thiadiazole 1,3,4-thiadiazole

Preferably, the thiadiazole derivative is a dimercaptothiadiazole derivative.

Thus, according to a particularly preferred embodiment, a lubricant composition according to the invention comprises at least one antiwear additive chosen from dimercaptothiazole derivatives.

The term "dimercaptothiadiazole derivative" according to the invention means chemical compounds derived from the following four dimercaptothiadiazole molecules below: 4,5-dimercapto-1,2,3-thiadiazole, 3,5-dimercapto-1,2,4-thiadiazole, 3,4-dimercapto-1,2,5-thiadiazole, 2,5-dimercapto-1,3,4-thiadiazole, taken alone or as a mixture:

[Chem 7]

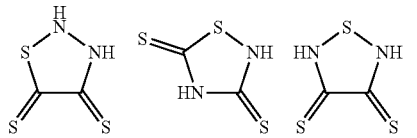

4,5-dimercapto-1,2,3-thiadiazole 3,5-dimercapto-1,2,4-thiadiazole 3,4-dimercapto-1,2,5-thiadiazole

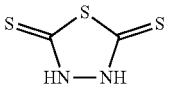

2,5-dimercapto-1,3,4-thiadiazole

The dimercaptothiadiazole derivatives are more particularly molecules or a mixture of molecules based on 4,5-dimercapto-1,2,3-thiadiazole, 3,5-dimercapto-1,2,4-thiadiazole, 3,4-dimercapto-1,2,5-thiadiazole or 2,5-dimercapto-1,3,4-thiadiazole, as represented above, in which at least one of the substitutions =S, or even both substitutions =S on the thiadiazole ring is replaced with a substituent:

[Chem 8]

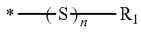

in which * represents the bond with a carbon atom of the 5-membered ring; n represents an integer equal to 1, 2, 3 or 4; and $R_1$ is chosen from a hydrogen atom, a linear or branched, saturated or unsaturated alkyl group comprising from 1 to 24, preferably from 2 to 18, more preferentially from 4 to 16 and even more preferentially from 8 to 12 carbon atoms or an aromatic substituent.

In particular, taking 2,5-dimercapto-1,3,4-thiadiazole as example, the 2,5-dimercapto-1,3,4-thiadiazole derivatives are molecules having the following formulae, taken alone or as a mixture:

[Chem 9]

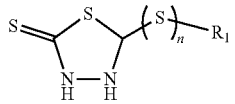

[Chem 10]

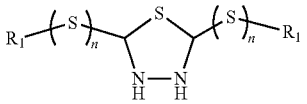

in which the group(s) $R_1$ represent, independently of each other, hydrogen atoms, linear or branched alkyl or alkenyl groups comprising from 1 to 24, preferably from 2 to 18, more preferentially from 4 to 16 and even more preferentially from 8 to 12 carbon atoms or aromatic substituents, n being, independently of each other, integers equal to 1, 2, 3 or 4, n preferably being equal to 1.

Preferably, $R_1$ represent, independently of each other, linear $C_1$ to $C_{24}$, preferably $C_2$ to $C_{18}$, notably $C_4$ to $C_{16}$, more particularly $C_8$ to $C_{12}$ and preferably $C_{12}$ alkyl groups.

The dimercaptothiadiazole derivatives used in the present invention may be commercially available, for example from the suppliers Vanderbilt, Rhein Chemie or Afton.

Polysulfide Additives

The amine-based and/or sulfur-based antiwear additive(s) used in a lubricant composition according to the invention may also be chosen from sulfur-based antiwear additives of polysulfide type, in particular sulfur-based olefins.

The sulfur-based olefins used in a lubricant composition according to the invention may notably be dialkyl sulfides represented by the general formula $R_a$—$S_x$—$R_b$, in which $R_a$ and $R_b$ are alkyl groups including from 3 to 15 carbon atoms, preferentially from 1 to 5 carbon atoms, preferentially 3 carbon atoms, and x is an integer between 2 and 6.

Preferably, the polysulfide additive is chosen from dialkyl trisulfides.

Preferably, the antiwear additive present in a composition used according to the invention is chosen from amine-based and sulfur-based antiwear additives, and advantageously from thia(di)azole compounds as described above and more preferentially from dimercaptothiadiazole derivatives.

A lubricant composition under consideration according to the invention may comprise from 0.01% to 5% by mass, in particular from 0.1% to 3% by mass, and more particularly from 0.5% to 2% by mass, of amine-based and/or sulfur-based antiwear additive(s), preferably of thia(di)azole type and more preferentially chosen from dimercaptothiadiazole derivatives, relative to the total mass of the lubricant composition.

The use of other antiwear additives, notably known for lubricants for propulsion systems, other than amine-based and/or sulfur-based additives, is envisageable, provided that they do not affect the properties imparted by the combination of said triazole compound(s) and of said amine-based and/or sulfur-based antiwear additive(s) according to the invention.

Preferably, a lubricant composition required according to the invention is free of antiwear additives other than said amine-based and/or sulfur-based antiwear additive(s) used according to the invention.

According to a particularly preferred embodiment, a lubricant composition under consideration according to the invention combines:

one or more additives of triazole type chosen from benzotriazole derivatives, preferably tolyltriazole derivatives, and notably those of formula (IIa) indicated above; and one or more amine-based and sulfur-based antiwear additives, preferably chosen from dimercaptothiazole derivatives, in particular as defined above.

According to a particularly preferred embodiment, a lubricant composition under consideration according to the invention combines, as amine-based and/or sulfur-based antiwear additive, a 2,5-dimercapto-1,3,4-thiadiazole derivative and, as triazole compound, a tolyltriazole derivative, in particular 2-ethyl-N-(2-ethylhexyl)-N-[(4-methylbenzotriazol-1-yl)methyl]hexan-1-amine.

Lubricant Composition

A composition used according to the invention may comprise, besides one or more additives of triazole type and one or more amine-based and/or sulfur-based antiwear additives, in particular as defined previously, one or more base oils, and also other additives, conventionally considered in lubricant compositions.

Base Oil

A lubricant composition under consideration according to the invention may thus comprise one or more base oils.

These base oils may be chosen from the base oils conventionally used in the field of lubricant oils, such as mineral, synthetic or natural, animal or plant oils or mixtures thereof.

It may be a mixture of several base oils, for example a mixture of two, three or four base oils.

In the continuation of the text, the term "fluid base" will denote the base oil or mixture of base oils of the lubricant composition under consideration according to the invention.

The base oils of the lubricant compositions under consideration according to the invention may in particular be oils of mineral or synthetic origin belonging to groups I to V according to the classes defined in the API classification (or equivalents thereof according to the ATIEL classification) and presented in Table 1 below or mixtures thereof.

TABLE 1

| | Content of saturates | Sulfur content | Viscosity index (VI) |
|---|---|---|---|
| Group I Mineral oils | <90% | >0.03% | 80 ≤ VI < 120 |
| Group II Hydrocracked oils | ≥90% | ≤0.03% | 80 ≤ VI < 120 |
| Group III Hydrocracked or hydroisomerized oils | ≥90% | ≤0.03% | ≥120 |
| Group IV | Poly-α-olefins (PAO) | | |
| Group V | Esters and other bases not included in groups I to IV | | |

The mineral base oils include all types of base oils obtained by atmospheric and vacuum distillation of crude oil, followed by refining operations such as solvent extraction, deasphalting, solvent deparaffinning, hydrotreating, hydrocracking, hydroisomerization and hydrofinishing.

Mixtures of synthetic and mineral oils, which may be biobased, may also be used.

There is generally no limit as regards the use of different base oils for preparing the compositions used according to the invention, other than the fact that they must have properties, notably in terms of viscosity, viscosity index or resistance to oxidation, that are suitable for use for the propulsion systems of an electric or hybrid vehicle.

The base oils of the compositions used according to the invention may also be chosen from synthetic oils, such as certain esters of carboxylic acids and of alcohols, poly-α-olefins (PAO) and polyalkylene glycols (PAG) obtained by polymerization or copolymerization of alkylene oxides comprising from 2 to 8 carbon atoms, in particular from 2 to 4 carbon atoms. The PAOs used as base oils are obtained, for example, from monomers comprising from 4 to 32 carbon atoms, for example from octene or decene. The weight-average molecular mass of the PAO may vary quite broadly. Preferably, the weight-average molecular mass of the PAO is less than 600 Da. The weight-average molecular mass of the PAO may also range from 100 to 600 Da, from 150 to 600 Da or from 200 to 600 Da.

Advantageously, the base oil(s) of the composition used according to the invention are chosen from poly-α-olefins (PAO), polyalkylene glycols (PAG) and esters of carboxylic acids and of alcohols.

Preferably, the base oil(s) of the composition used according to the invention is(are) chosen from group III, IV or V oils, and mixtures thereof, preferably it is a group III base oil.

According to an alternative embodiment, the base oil(s) of the composition used according to the invention may be chosen from group II base oils.

It falls to a person skilled in the art to adjust the content of base oil to be used in a composition that is suitable for use in the invention.

A lubricant composition under consideration according to the invention may comprise at least 50% by mass of base oil(s) relative to its total mass, in particular from 60% to 99% by mass of base oil(s).

Additional Additives

A lubricant composition that is suitable for use in the invention may also comprise any type of additive, different from the additives of triazole type and from the amine-based and/or sulfur-based antiwear additives defined in the context of the present invention, that are suitable for use in a lubricant for a propulsion system of an electric or hybrid vehicle.

It is understood that the nature and amount of additives used are chosen so as not to affect the properties in terms of antiwear and anticorrosion performance imparted by the combination of said triazole compound(s) and of said amine-based and/or sulfur-based additive(s) used according to the invention.

Such additives, which are known to a person skilled in the art in the field of the lubrication and/or cooling of the propulsion systems of electric or hybrid vehicles, may be chosen from friction modifiers, viscosity index modifiers, detergents, extreme-pressure additives, dispersants, antioxidants, pour point depressants, antifoams and mixtures thereof.

Advantageously, a composition that is suitable for use in the invention comprises at least one additional additive chosen from antioxidants, detergents, dispersants, pour point depressant additives, antifoams, and mixtures thereof.

These additives may be introduced individually and/or in the form of a mixture such as those already available for sale for commercial lubricant formulations for vehicle engines, with a performance level as defined by the ACEA (Association des Constructeurs Européens d'Automobiles) and/or the API (American Petroleum Institute), which are well known to those skilled in the art.

A lubricant composition that is suitable for use in the invention may comprise at least one friction-modifying additive. The friction-modifying additive may be chosen from a compound providing metal elements and an ash-free compound. Among the compounds providing metal elements, mention may be made of complexes of transition metals such as Mo. Sb, Sn, Fe, Cu or Zn, the ligands of which may be hydrocarbon-based compounds comprising oxygen, nitrogen, sulfur or phosphorus atoms. The ash-free friction-modifying additives are generally of organic origin and may be chosen from fatty acid monoesters of polyols, alkoxylated amines, alkoxylated fatty amines, fatty epoxides, borate fatty epoxides, fatty amines or fatty acid esters of glycerol. According to the invention, the fatty compounds comprise at least one hydrocarbon-based group comprising from 10 to 24 carbon atoms.

A lubricant composition that is suitable for use according to the invention may comprise from 0.01% to 2% by weight or from 0.01% to 5% by weight, preferentially from 0.1% to 1.5% by weight or from 0.1% to 2% by weight of friction-modifying additive, relative to the total weight of the composition.

A lubricant composition used according to the invention may comprise at least one antioxidant additive.

The antioxidant additive generally makes it possible to retard the degradation of the composition in service. This degradation may notably be reflected by the formation of deposits, the presence of sludges, or by an increase in the viscosity of the composition.

The antioxidant additives notably act as free-radical inhibitors or hydroperoxide destroyers. Among the commonly used antioxidant additives, mention may be made of antioxidant additives of phenolic type, antioxidant additives of amine type and phospho-sulfur-based antioxidant additives. Some of these antioxidant additives, for example the phospho-sulfur-based antioxidant additives, may be ash generators. The phenolic antioxidants additives may be ash-free or may be in the form of neutral or basic metal salts. The antioxidants additives may notably be chosen from sterically hindered phenols, sterically hindered phenol esters and sterically hindered phenols comprising a thioether bridge, diphenylamines, diphenylamines substituted with at least one $C_1$-$C_{12}$ alkyl group, N,N'-dialkyl-aryl-diamines, and mixtures thereof.

Preferably according to the invention, the sterically hindered phenols are chosen from compounds comprising a phenol group, in which at least one carbon vicinal to the carbon bearing the alcohol function is substituted with at least one $C_1$-$C_{10}$ alkyl group, preferably a $C_1$-$C_6$ alkyl group, preferably a $C_4$ alkyl group, preferably with a tert-butyl group.

Amine compounds are another class of antioxidant additives that may be used, optionally in combination with the phenolic antioxidants additives. Examples of amine compounds are aromatic amines, for example the aromatic amines of formula $NR^4R^5R^6$ in which $R^4$ represents an optionally substituted aliphatic or aromatic group, $R^5$ represents an optionally substituted aromatic group, $R^6$ represents a hydrogen atom, an alkyl group, an aryl group or a group of formula $R^7S(O)_zR^8$ in which $R^7$ represents an alkylene group or an alkenylene group, $R^8$ represents an alkyl group, an alkenyl group or an aryl group and z represents 0, 1 or 2.

Sulfurized alkylphenols or the alkali metal and alkaline-earth metal salts thereof may also be used as antioxidant additives.

Another class of antioxidant additives is that of copper compounds, for example copper thio- or dithio-phosphates, copper salts of carboxylic acids, and copper dithiocarbamates, sulfonates, phenates and acetylacetonates. Copper I and II salts and succinic acid or anhydride salts may also be used.

A lubricant composition used according to the invention may contain any type of antioxidant additive known to those skilled in the art.

Advantageously, a lubricant composition used according to the invention comprises at least one ash-free antioxidant additive.

A lubricant composition used according to the invention may comprise from 0.5% to 2% by weight of at least one antioxidant additive, relative to the total weight of the composition.

According to a particular embodiment, a lubricant composition used according to the invention is free of antioxidant additives of aromatic amine type or of sterically hindered phenol type.

A lubricant composition that is suitable for use in the invention may also comprise at least one detergent additive.

The detergent additives generally make it possible to reduce the formation of deposits on the surface of metal parts by dissolving the oxidation and combustion byproducts.

The detergent additives that may be used in a lubricant composition used according to the invention are generally known to those skilled in the art. The detergent additives may be anionic compounds comprising a long lipophilic hydrocarbon-based chain and a hydrophilic head. The associated cation may be a metal cation of an alkali metal or an alkaline-earth metal.

The detergent additives are preferentially chosen from alkali metal or alkaline-earth metal salts of carboxylic acids, sulfonates, salicylates and naphthenates, and also phenate salts.

The alkali metals and alkaline-earth metals are preferentially calcium, magnesium, sodium or barium.

These metal salts generally comprise the metal in a stoichiometric amount or in excess, thus in an amount greater than the stoichiometric amount. They are then overbased detergent additives; the excess metal giving the overbased nature to the detergent additive is then generally in the form of a metal salt that is insoluble in the oil, for example a carbonate, a hydroxide, an oxalate, an acetate or a glutamate, preferentially a carbonate.

A lubricant composition that is suitable for use in the invention may comprise, for example, from 2% to 4% by weight of detergent additive relative to the total weight of the composition.

Also, a lubricant composition used according to the invention may comprise at least one dispersant.

The dispersant may be chosen from Mannich bases, succinimides and derivatives thereof.

A lubricant composition used according to the invention may comprise, for example, from 0.2% to 10% by weight of dispersant, relative to the total weight of the composition.

According to a particular embodiment, a lubricant composition used according to the invention is free of dispersant of succinimide type.

A lubricant composition that is suitable for use in the invention may also comprise at least one antifoam.

The antifoam may be chosen from silicones.

A lubricant composition that is suitable for use in the invention may comprise from 0.01% to 2% by mass or from 0.01% to 5% by mass, preferentially from 0.1% to 1.5% by mass or from 0.1% to 2% by mass of antifoam, relative to the total weight of the composition.

A lubricant composition that is suitable for use in the invention may also comprise at least one pour-point depressant (PPD).

By slowing down the formation of paraffin crystals, the pour-point depressant additives generally improve the cold-temperature behavior of the composition. Examples of pour-point depressant additives that may be mentioned include polyalkyl methacrylates, polyacrylates, polyarylamides, polyalkylphenols, polyalkylnaphthalenes and polyalkylstyrenes.

In particular, a lubricant composition used according to the invention may be free of dispersant of succinimide type and of antioxidant additive of aromatic amine type or of sterically hindered phenol type.

In terms of formulation of such a lubricant composition, said triazole compound(s) may be added to a base oil or mixture of base oils, and the other additional additives, including the amine-based and/or sulfur-based antiwear additive(s), are then added.

Alternatively, said triazole compound(s) may be added to a pre-existing conventional lubricant formulation, notably comprising one or more base oils, one or more amine-based and/or sulfur-based antiwear additives, and optionally additional additives.

Advantageously, a lubricant composition used according to the invention has a kinematic viscosity, measured at 100° C. according to the standard ASTM D445, ranging from 1 to 15 $mm^2/s$.

Advantageously, a lubricant composition used according to the invention has a kinematic viscosity, measured at 40° C. according to the standard ASTM D445, ranging from 3 to 80 $mm^2/s$.

According to an advantageous embodiment of the present invention, the electrical resistivity values measured at 90° C. for the lubricant compositions used according to the invention are between 5 and 10 000 Mohm·m, more preferably between 6 and 5000 Mohm·m.

According to an advantageous embodiment of the present invention, the dielectric loss values measured at 90° C. for the lubricant compositions used according to the invention are between 0.01 and 30, more preferably between 0.02 and 25 and more preferentially between 0.02 and 10.

Advantageously, a lubricant composition used according to the invention may be of a grade according to the SAEJ300 classification defined by the formula (X)W(Y), in which X represents 0 or 5, and Y represents an integer ranging from 4 to 20, in particular ranging from 4 to 16 or from 4 to 12.

According to a particular embodiment, a lubricant composition used according to the invention comprises, or even consists of:

- a base oil or mixture of base oils, preferably chosen from poly-α-olefins (PAO), polyalkylene glycols (PAG) and esters of carboxylic acids and of alcohols;
- one or more anticorrosion additives of triazole type, preferably chosen from benzotriazole derivatives, in particular tolyltriazole derivatives, and more preferentially those of formula (IIa) indicated above;
- one or more amine-based and/or sulfur-based antiwear additives, preferably one or more amine-based and sulfur-based antiwear additives, more preferentially chosen from compounds of thia(di)azole type, in particular dimercaptothiazole derivatives as defined above;
- optionally one or more additional additives chosen from antioxidants, detergents, dispersants, pour point depressant additives, antifoams, and mixtures thereof.

Preferably, a lubricant composition used according to the invention comprises, or even consists of:

- from 0.01% to 5% by mass, in particular from 0.1% to 3% by mass, and more particularly from 0.5% to 2% by mass, of one or more anticorrosion additives of triazole type, preferably chosen from benzotriazole derivatives, in particular tolyltriazole derivatives, and more preferentially those of formula (IIa) indicated above;

from 0.01% to 5% by mass, in particular from 0.1% to 3% by mass, and more particularly from 0.5% to 2% by mass, of one or more amine-based and/or sulfur-based antiwear additives, preferably one or more amine-based and sulfur-based antiwear additives, more preferentially chosen from compounds of thia(di)azole type, in particular dimercaptothiazole derivatives as defined above;

from 60% to 99.9% by mass of base oil(s), preferably chosen from poly-α-olefins (PAO), polyalkylene glycols (PAG) and esters of carboxylic acids and of alcohols, and mixtures thereof;

optionally from 0.01% to 5% by mass of one or more additives chosen from antioxidants, detergents, dispersants, pour point depressant additives, antifoams, and mixtures thereof; the contents being expressed relative to the total mass of said lubricant composition.

Application

As indicated previously, a lubricant composition that is suitable for use in the invention as described previously is used as lubricant for a propulsion system of an electric or hybrid vehicle, and more particularly for the motor and the power electronics.

Thus, the present invention relates to the use of a lubricant composition as defined previously, combining one or more anticorrosion additives of triazole type, in particular as defined previously, preferably tolyltriazole derivatives, and one or more amine-based and/or sulfur-based antiwear additives, preferably dimercaptothiazole derivatives, for lubricating a propulsion system of an electric or hybrid vehicle, in particular for lubricating the electric motor and the power electronics of an electric or hybrid vehicle.

As represented schematically in FIG. 1, the propulsion system of an electric or hybrid vehicle notably comprises the electric motor part (1), an electric battery (2) and a transmission, and in particular a speed reducer (3).

The electric motor typically comprises power electronics (11) connected to a stator (13) and a rotor (14). The stator comprises coils, in particular copper coils, which are powered by an alternating electric current. This makes it possible to generate a rotating magnetic field. For its part, the rotor comprises coils, permanent magnets or other magnetic materials, and is placed in rotation by the rotating magnetic field.

A rolling bearing (12) is generally incorporated between the stator (13) and the rotor (14). A transmission, and in particular a speed reducer (3), makes it possible to reduce the rotation speed at the outlet of the electric motor and to adapt the speed transmitted to the wheels, making it possible simultaneously to control the speed of the vehicle.

The rolling bearing (12) is notably subjected to high mechanical stresses and poses problems of wear by fatigue. It is thus necessary to lubricate the rolling bearing in order to increase its service life. Also, the reducer is subject to high friction stresses and thus needs to be appropriately lubricated in order to prevent it from being damaged too quickly.

Thus, the invention relates in particular to the use of a composition as described previously for lubricating an electric motor of an electric or hybrid vehicle, in particular for lubricating the rolling bearings located between the rotor and the stator of an electric motor.

The invention also relates to the use of a composition as described previously for lubricating the transmission, in particular the reducer, in an electric or hybrid vehicle.

Advantageously, a composition according to the invention may thus be used for lubricating the various parts of a propulsion system of an electric or hybrid vehicle, in particular the rolling bearings located between the rotor and the stator of an electric motor, and/or the transmission, in particular the reducer, in an electric or hybrid vehicle.

Advantageously, as mentioned previously, a lubricant composition according to the invention has excellent antiwear and anticorrosion performance.

According to another of its aspects, the invention also relates to a process for lubricating at least one part of a propulsion system of an electric or hybrid vehicle, in particular the rolling bearings located between the rotor and the stator of an electric motor; and/or the transmission, notably the reducer, comprising at least one step of placing at least said part in contact with a composition as described previously.

The present invention thus proposes a process for simultaneously reducing the wear and corrosion of at least one part of a propulsion system of an electric or hybrid vehicle, in particular the rolling bearings located between the rotor and the stator of an electric motor; and/or the transmission, notably the reducer, said process comprising at least one step of placing at least said part in contact with a composition as described previously.

All of the features and preferences described for the composition used according to the invention and for the uses thereof also apply to this process.

According to a particular embodiment, a composition according to the invention may have, besides lubricating properties, good electrical insulation properties.

According to this embodiment, a composition according to the invention may simultaneously be used for lubricating one or more parts of a propulsion system of an electric or hybrid vehicle, in particular for lubricating the sensors and the solenoid valves of the motor, the rolling bearings, but also the windings located in the rotor and the stator of an electric motor, or else for lubricating the transmission, in particular the gears, the sensors, the solenoid valves or the reducer which are found in an electric or hybrid vehicle, and for electrically insulating at least one part of said propulsion system, notably the battery.

In the context of such an implementation variant, a lubricant composition under consideration according to the invention advantageously has a kinematic viscosity, measured at 100° C. according to the standard ASTM D445, of between 2 and 8 $mm^2/s$, preferably between 3 and 7 $mm^2/s$.

It is understood that the uses described above may be combined, a composition as described previously possibly being used both as lubricant and as electrical insulator, but also as coolant fluid for the motor, the battery and the transmission of an electric or hybrid vehicle. According to the invention, the particular, advantageous or preferred features of the composition according to the invention make it possible to define uses according to the invention that are also particular, advantageous or preferred.

The invention will now be described by means of the examples that follow, which are, needless to say, given as nonlimiting illustrations of the invention.

EXAMPLE

Various compositions were evaluated:

a composition C1 comprising an amine-based and sulfur-based antiwear additive of dimercaptothiadiazole type free of anticorrosion additive;

a composition C2 comprising said antiwear additive of dimercaptothiadiazole type and an anticorrosion additive of triazole type, in accordance with the invention, of formula (IIa) mentioned above: 2-ethyl-N-(2-ethylhexyl)-N-[(4-methylbenzotriazol-1-yl)methyl]hexan-1-amine;

a composition C3 comprising said antiwear additive of dimercaptothiadiazole type and an anticorrosion additive not in accordance with the invention, of alkylated organic acid ester type;

a composition C4 comprising said antiwear additive of dimercaptothiadiazole type and an anticorrosion additive not in accordance with the invention, of N-acyl sarcosine type (N-oleyl sarcosine); and a composition C5 comprising said antiwear additive of dimercaptothiadiazole type and an anticorrosion additive not in accordance with the invention, of imidazoline derivative type.

Compositions C1 to C5 comprise, besides the abovementioned compounds, a group III base oil.

The compositions and the amounts (expressed as mass percentages) are indicated in Table 2 below.

TABLE 2

| | C1 | C2 | C3 | C4 | C5 |
|---|---|---|---|---|---|
| Base oil | 99% | 98% | 98% | 98% | 98% |
| Dimercaptothiadiazole antiwear agent | 1% | 1% | 1% | 1% | 1% |
| Tolyltriazole derivative anticorrosion agent | — | 1% | — | — | — |
| Alkylated organic acid ester anticorrosion agent | — | — | 1% | — | — |
| N-oleyl sarcosine anticorrosion agent | — | — | — | 1% | — |
| Imidazoline derivative anticorrosion agent | — | — | — | — | 1% |

Evaluation of the Anticorrosion Properties

Evaluation Method

The corrosive (or corroding) power of a composition may be evaluated by means of a test involving study of the variation in the electrical resistance value of a copper wire of a preestablished diameter, as a function of the duration of immersion of this wire in the composition. The variation in this electrical resistance value is directly correlated with the variation in the diameter of the test wire. In the context of the present invention, the diameter of the wire chosen is 70 μm.

In the present case, a copper wire is immersed in a test tube containing 20 mL of a test composition (composition C2 being a composition according to the invention and compositions C1 and C3 to C5 being compositions serving as a comparative).

The resistance of the wire is measured using an ohmmeter.

The measuring current is 1 mA.

The temperature of the test composition is brought to 150° C.

The resistance of the copper wire is calculated by this equation (1):

$$R \times \rho \times \frac{L}{S} \quad \text{[Math 1]}$$

in which R is the resistance, ρ is the resistivity of copper, L is the length of the wire and S is the cross-sectional area.

In this equation (1), ρ and L are constants. Thus, the resistance R is inversely proportional to the cross-sectional area of the immersed wire.

The diameter of the wire is calculated from the cross-sectional area (equation (2)):

$$S = \frac{\pi}{4} \times D^2 \quad \text{[Math 2]}$$

in which D is the diameter of the wire.

Equation (2) is inserted into equation (1) to obtain the relationship between the resistance and the diameter (equation (3)):

$$R = \rho \times \frac{L}{\frac{\pi}{4} \times D^2} \quad \text{[Math 3]}$$

Thus, when the wire is corroded by the test compositions, the diameter of the wire decreases, thus bringing about an increase in the resistance value.

By monitoring the resistance, it is possible to monitor the change in the diameter of the wire, which reflects the state of corrosion suffered by the immersed wire.

The loss of diameter of the wire is thus calculated directly from the measured resistance.

When the measured resistance is infinite, this is an open circuit. The wire has thus broken, which defines very severe corrosion.

Results

The results are summarized in the following table 3 and are expressed in μm (loss of diameter). The lower the value obtained, the better the anticorrosion properties of the composition evaluated.

A composition is considered to be "noncorrosive" when the loss of diameter of the copper wire studied is less than or equal to 0.5 μm after immersion for 80 hours, in particular less than or equal to 0.1 μm after immersion for 20 hours in the composition.

TABLE 3

| Compositions | C1 | C2 | C3 | C4 | C5 |
|---|---|---|---|---|---|
| Loss of diameter (in μm) at 30 hours | 1.00 | 0.17 | 0.55 | 0.88 | Broken wire |
| Loss of diameter (in μm) at 50 hours | Broken wire | 0.23 | Broken wire | 2.00 | Broken wire |
| Loss of diameter (in μm) at 80 hours | Broken wire | 0.43 | Broken wire | Broken wire | Broken wire |

It emerges from these results that the addition of a triazole compound in a lubricant composition also comprising at least one amine-based and/or sulfur-based antiwear additive makes it possible to achieve significantly improved anticorrosion properties compared with lubricant compositions free of triazole compounds or comprising anticorrosion additives different from triazole compounds.

The invention claimed is:

1. A method for improving the anti-corrosion properties of a lubricant composition for a propulsion system of an electric or hybrid vehicle, comprising:

adding at least one triazole compound to a lubricant composition for lubricating the propulsion system, the lubricant composition comprising from 0.5% to 2% by mass, relative to the total mass of the lubricant composition, of at least one anti-wear additive chosen from polysulfide additives, amine phosphates, phospho-sulfur additives, sulfur-based olefins, alkylthiophosphates, dimercaptothiadiazole derivatives, 2,5-dimercapto-1,3,4-thiadiazole derivatives, or mixtures of two or more thereof, wherein the 2,5-dimercapto-1,3,4-thiadiazole derivatives are chosen from compounds having the following formulae:

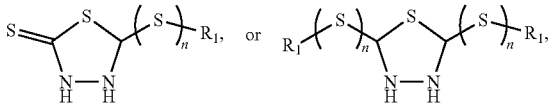

wherein:

each $R_1$ group is independently selected from a hydrogen atom, a linear or branched alkyl or alkenyl group comprising from 2 to 18 carbon atoms, or an aromatic substituent; and each n is independently selected from 1, 2, 3, or 4, and wherein the at least one triazole compound is a tolyltriazole derivative represented by the following formula:

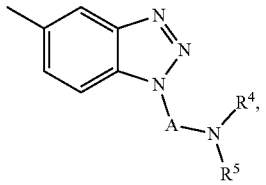

wherein:

$R^4$ and $R^5$ are independently selected from a hydrogen atom or a branched $C_6$ to $C_{12}$ alkyl group; and -A- represents a methylene group (—$CH_2$—) group.

2. The method of claim 1, wherein the at least one triazole compound is chosen from optionally substituted triazoles, benzotriazoles and derivatives thereof, or a combination thereof.

3. The method of claim 1, wherein the at least one triazole compound is chosen from 1,2,3-triazole, a tolyltriazole derivative, or a combination thereof.

4. The method of claim 1, wherein the tolyltriazole derivative is 2-ethyl-N-(2-ethylhexyl)-N-[(4-methylbenzotriazol-1-yl)methyl]hexan-1-amine.

5. The method of claim 1, wherein:

each $R_1$ group is independently selected from a hydrogen atom, linear or branched alkyl or alkenyl groups comprising from 8 to 12 carbon atoms or aromatic substituents; and n is 1.

6. The method of claim 1, wherein the at least one triazole compound is present in an amount ranging from 0.01% to 5% by mass, relative to the total mass of the lubricant composition.

7. The method of claim 6, wherein the at least one triazole compound is present in an amount ranging from 0.5% to 2% by mass, relative to the total mass of the lubricant composition.

8. The method of claim 1, wherein:

the at least one anti-wear additive is a 2,5-dimercapto-1,3,4-thiadiazole derivative; and the at least one triazole compound is 2-ethyl-N-(2-ethylhexyl)-N-[(4-methylbenzotriazol-1-yl)methyl]hexan-1-amine.

9. A method of reducing corrosion in a propulsion system of an electric or hybrid vehicle, comprising lubricating an electric motor and/or power electronics of the electric or hybrid vehicle with a lubricant composition comprising:

an anti-corrosion additive comprising at least one triazole compound; and from 0.5% to 2% by mass, relative to the total mass of the lubricant composition, of at least one anti-wear additive chosen from polysulfide additives, amine phosphates, phospho-sulfur additives, sulfur-based olefins, alkylthiophosphates, dimercaptothiadiazole derivatives, 2,5-dimercapto-1,3,4-thiadiazole derivatives, or mixtures of two or more thereof, wherein the 2,5-dimercapto-1,3,4-thiadiazole derivatives are chosen from compounds having the following formulae:

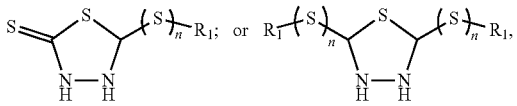

wherein:

each $R_1$ group is independently selected from a hydrogen atom, a linear or branched alkyl or alkenyl group comprising from 2 to 18 carbon atoms, or an aromatic substituent; and each n is independently selected from 1, 2, 3, or 4, and wherein the at least one triazole compound is a tolyltriazole derivative represented by the following formula:

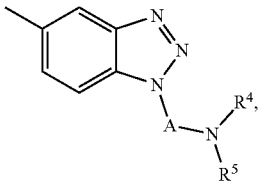

wherein:

$R^4$ and $R^5$ are independently selected from a hydrogen atom or a branched $C_6$ to $C_{12}$ alkyl group; and -A- represents a methylene group (—$CH_2$—) group.

10. The method of claim 9, wherein:

the at least one triazole compound is 2-ethyl-N-(2-ethylhexyl)-N-[(4-methylbenzotriazol-1-yl)methyl]hexan-1-amine; and the at least one anti-wear additive is a 2,5-dimercapto-1,3,4-thiadiazole derivative.

11. The method of claim 9, further comprising lubricating rolling bearings located between a rotor and a stator of the electric motor with the lubricant composition.

12. The method of claim 9, further comprising lubricating a transmission of the electric or hybrid vehicle with the lubricant composition.

* * * * *